United States Patent [19]

Hubbard

[11] 4,250,673

[45] Feb. 17, 1981

[54] WINDOW REPLACEMENT SYSTEM

[75] Inventor: S. Eugene Hubbard, Niles, Mich.

[73] Assignee: Kawneer Company, Inc., Niles, Mich.

[21] Appl. No.: 42,583

[22] Filed: May 25, 1979

[51] Int. Cl.[3] ..... E06B 1/04

[52] U.S. Cl. ..... 52/211; 52/741

[58] Field of Search ..... 52/211, 212, 217, 741, 52/202, 475, 788, 204

[56] References Cited

U.S. PATENT DOCUMENTS 2,912,078 11/1959 Kiehl et al. ..... 52/212

FOREIGN PATENT DOCUMENTS 1491894 11/1977 United Kingdom ..... 52/475

*Primary Examiner*—Carl D. Friedman

*Attorney, Agent, or Firm*—Mason, Kolehmainen, Rathburn & Wyss

[57] ABSTRACT

A new and improved method and apparatus for replacing old windows in an existing building with new windows and surrounding trim comprises the use of elongated, especially designed trim elements which are cut to length and assembled onto the replacement window frame to trim the periphery thereof. The replacement window frame with the peripheral trim elements bodily attached thereto is then mounted in the opening in the building wall structure to replace an old deteriorated window previously removed therefrom. The novel method of assembly and installation guarantees a good fit between the trim elements and the window frame, and permits the critical seal between the trim elements and the window frame to be formed at a convenient location during the assembly of the trim elements onto the window rather than requiring a trim seal to be effected after the window is installed in the building.

52 Claims, 8 Drawing Figures

10
12c
12c
88
59
30
20
26
34
60
61
57
62b
62c
85
82c
82a
83
82b
68
61
67
43
45
89
92
90
68a
67
62
63
64
66
86
91
82d
94
82
90b
62d
62a
80
87
90a
42a
44a
40
46
44
42
16
38
90a
32
90
52
42
44
90b
50
46
40
44a
42a
87
82d
94
82
90a
58a
80
72a
76
43
86
91
90b
58
73
45
89
92
90
74
72c
82b
36
77
72
72b
83
82c
77
52c
85
82a
70
54
61
57
61
56
24
18
28
22
88
78
59
12c
10

WINDOW REPLACEMENT SYSTEM

BACKGROUND OF THE INVENTION

1. Field of the Invention

The present invention relates to a new and improved window replacement system for use in remodeling existing buildings and the like wherein the old windows have deteriorated and must be replaced.

2. Description of the Prior Art

Many old buildings exist which are structurally sound and which have ideal locations but which are economically disadvantaged because of the deteriorated condition of the windows and the excessive heat losses and undesirable side effects caused thereby. Because of the increasing energy costs, in order to make the remodeling of a building economically feasible, it is desirable to replace old deteriorated windows therein to reduce energy costs.

Specifically, replacement usually begins by removal of the old window sashes while leaving an existing frame of metal or wood and the outer trim in tact. New windows preferably of the double glazed and heat insulating type, are then installed in the window openings and various types of trim members are thereafter secured in place and sealed around between the peripheral edges of a new replacement window frame and the adjacent edges of the old window opening.

Because such a great variety exists in types of windows, trim and frame arrangements in existing buildings sought to be remodeled and updated for energy corrections, an approach to the problem has not been feasible or realized in the prior art. Moreover, the task of installing tight sealing and nice looking trim elements around a newly installed replacement window has been difficult and costly with often times undesirable consequences such as unsightly appearance and weather leakage.

OBJECTS OF THE PRESENT INVENTION

It is an object of the present invention to provide a new and improved replacement window system for use in existing buildings and more particularly, it is an object of the present invention to provide a new and improved replacement window system wherein trim elements are installed around the peripheral edges of the replacement windows before the installation or mounting of these windows in the openings in an existing building from which openings, the old and/or deteriorated windows have been removed.

Another object of the present invention is to provide a new and improved replacement window system of the character described suitable for use wherein old and/or deteriorated window sashes are removed from an existing building leaving an existing outer window frame and trim intact.

It is another object of the invention to provide a new and improved replacement window system of the character described which includes a replacement window with peripheral trim elements attached and sealed therewith adapted to be mounted in a window opening of an existing building structure having outer window frame and/or trim elements therein covered by the new window trim.

Another object of the present invention is to provide a new and improved method of replacing the deteriorated and/or windows in an existing building with new windows having improved operating characteristics.

Yet another object of the present invention is to provide a new and improved replacement window system employing a novel design for trim element which is easily cut to length and installed on a replacement window frame prior to mounting of the interior frame into an existing opening from which a window to be replaced had been removed.

Still another object of the present invention is to provide a new and improved replacement window system wherein the difficulty of sealing between the replacement window trim elements and the existing wall structure is minimized.

Still another object of the present invention is to provide a new and improved replacement window system wherein a replacement window with a peripheral trim is provided to easily fit into an existing window opening to cover the old trim and/or frame elements of a window that has been removed.

Yet another object of the present invention is to provide a new and improved elongated trim element for use with a replacement window adapted to be pivotally interconnected and sealed against an outer edge portion of the window frame.

Still another object of the present invention is to provide a new and improved trim element for use with a replacement window and adapted to seal around and cover an existing frame and/or trim elements left in place in a building wall structure.

Still another object of the present invention is to provide a new and improved elongated trim element which is especially adapted to interfit around the outer periphery of a replacement window frame and which is readily installed to form a complete peripheral trim around the window for sealing between the window and the surround of an existing window opening.

Still another object of the present invention is to provide a new and improved replacement window system wherein a novel mounting support element is included for rapidly installing and securing a replacement window in an existing window opening.

Still another object of the present invention is to provide a new and improved replacement window system of the character described wherein elongated interior trim elements are provided to interfit and trim around the periphery of the replacement window on the interior side thereof.

Still another object of the present invention is to provide a new and improved replacement window system wherein elongated interior trim elements are provided to snappingly interfit with window supporting elements on the interior side of a replacement window mounted in an existing window opening.

Another object of the present invention is to provide a new and improved replacement window system which permits the original window frame and trim to remain in place for aid in support of a replacement window.

BRIEF SUMMARY OF THE INVENTION

The foregoing and other objects and advantages of the present invention are accomplished in an illustrated embodiment comprising a new and improved replacement window system for installing a replacement window in the opening of an existing building wall structure, from which opening an old or deteriorated window has been removed. The new and improved system includes apparatus for trimming around the periphery on the outside of a replacement window and the trim apparatus includes elongated exterior trim elements having a flange adapted to extend outwardly of a side frame member of the window and an integral fascia portion joining the flange and extending between the flange and an adjacent edge of the opening in the wall that the replacement window is to be mounted in. The exterior trim elements are provided with elongated connector means along an inner edge of the flange for providing a continuous pivotal interlock between the side frame member of the replacement window and the trim element.

In accordance with the method of the present invention, the replacement window is initially trimmed before installation with a plurality of elongated exterior trim elements mounted thereon to form a complete trim frame around the periphery of the window. Weathertight sealing is effected between the trim elements and the window before the window with the attached trim is mounted in place in an existing opening of a building wall structure. The installation of the window is rapid and easy by using clip elements on the inside attached between the window frame and the existing frame of the old window that has been removed. A final peripheral seal is then completed around the exterior trim element and the wall finally, interior trim elements are mounted around the periphery of the replacement window after it is secured in position in the window opening.

BRIEF DESCRIPTION OF THE DRAWINGS

For a better understanding of the present invention, reference should be had to the following detailed description taken in conjunction with the drawings, in which:

FIG. 6 is a fragmentary, enlarged, exploded perspective view of a lower corner portion of the window replacement system of the present invention as seen from the inside;

FIG. 8 is a greatly, enlarged, fragmentary cross-sectional view taken substantially along lines 8—8 of FIG. 7 and illustrating a mounting clip element in a position ready for permanent attachment to the adjacent window frame member.

DESCRIPTION OF THE PREFERRED EMBODIMENT

Figure 1:
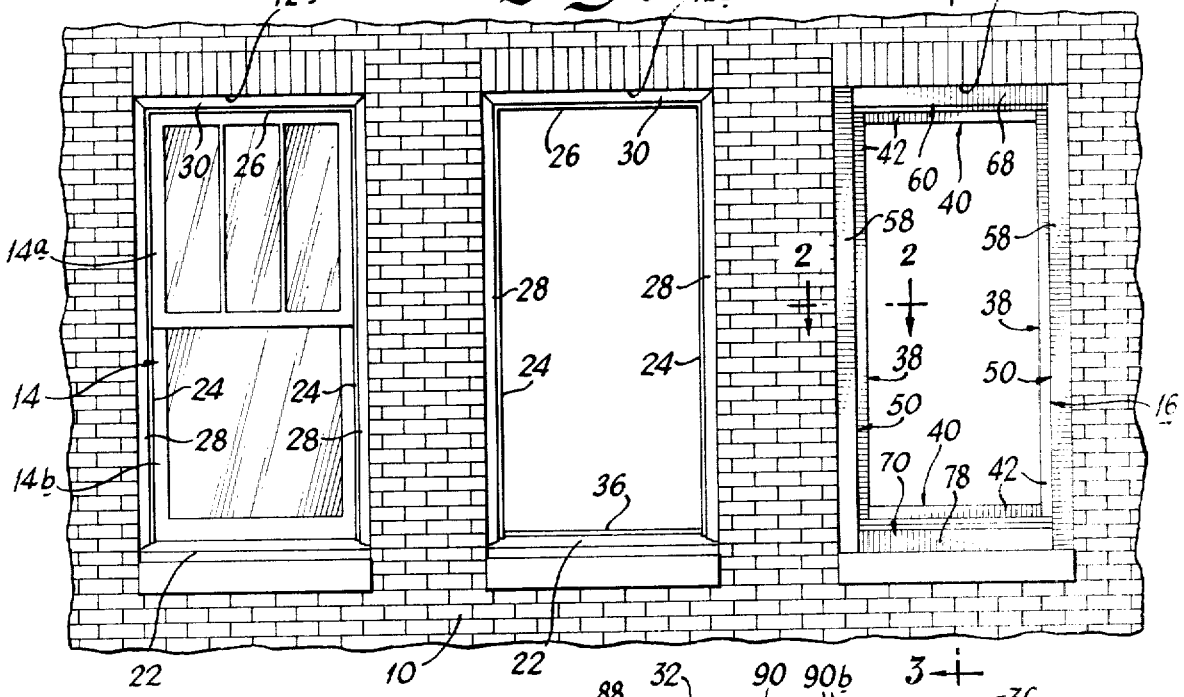
FIG. 1 is an outside elevational view of an existing building wall structure having a plurality of window openings therein and illustrating in somewhat animated fashion the method of the present invention wherein a deteriorated and/or old window is removed leaving intact a peripheral frame or trim element followed by the installation of a replacement window and trim system in accordance with the features of the present invention.

Referring now more particularly to the drawings, in FIG. 1 is illustrated an elevational view of a wall structure of an existing building referred to generally by the numeral 10. The existing wall structure is formed with a plurality of rectangularly shaped window openings 12*a*, 12*b* and 12*c*, respectively, left to right, and the left-hand window opening 12*a* is illustrated with an old and/or deteriorating, double hung, wood window 14 mounted therein which is to be replaced with a new, preferably heat insulating and modern type, replacement aluminum frame window such as a window 16, shown mounted in the right-hand window opening 12*c* of the wall.

In accordance with the present invention, an upper and lower sash 14*a* and 14*b* of the old deteriorating window 14 are removed for replacement and preferably, the rectangular supporting framework of the old window comprising a pair of vertical jambs 18, an upper header 20 and an outwardly and downwardly sloping lower sill 22 are left intact in place in the window opening. A pair of outside vertical jamb stops 24, a header stop 26 and a pair of outside brick or trim molding elements 28 adjacent the vertical jambs and a header brick molding 30 adjacent the header 20 are also left in place. In addition, a pair of vertical inside, jamb stops 32 and an inside header stop 34 and inside window sill member 36 may also be left intact in place after the old window sashes 14*a* and 14*b* have been removed. This arrangement provides for a rapid and fast conversion or remodeling process in that only the window sash and intermediate stops need be removed.

Preferably, the replacement window 16 is of a modern, heat insulating, aluminum frame type adapted to hold a single pane of double thickness insulating glass or one or more removable or openable operating sashes preferably of the type having insulating type glazing. The support frame of the replacement window is of a generally rectangular shape having a width and height dimension slightly less than the distance or width measurement between the opposite jamb stops 24 and a height distance measurement slightly less than the vertical or height distance between the upper header stop 26 and the sill 22 of the old window frame. If the old window frame and trim members are removed along with the old window sashes 14*a* and 14*b*, the size of the new replacement window 16 may be increased slightly if desired.

The rectangular frame of the new or replacement window 16 includes a pair of vertical stiles 38 interconnected adjacent the upper and lower ends by a pair of horizontally extending upper and lower rails 40 which are butt fitted against inside flange portions of the vertical stiles as shown. Preferably, both the stiles and the rails are identical in transverse cross-section and are of the heat insulating type including an outer face member 42 of extruded aluminum, an inner face member 44 of substantially identical cross-section and a continuous interconnecting structural insulating strip 46 between the outer and inner face members. The strip of insulating material 46 is of a cross-shaped transverse cross-section in keyed interconnection with opposite facing grooves provided in the metal face members.

The outer face members 42 of the window frame elements include an outer wall 42a and on the inside surface, spaced closely adjacent an outside edge, there is provided an elongated groove 43 which faces and is opposite to a similar groove 45 on an inside face portion 44a of the inner face member 44. The elongated continuous groove 43 provides for a positive, pivotal, interlocking interconnection between the window frame element and an elongated side trim element 50 of generally angle-shaped, transverse cross-section constructed in accordance with the features of the present invention. A pair of side or jamb trim elements 50 are provided on opposite sides of the window 16 and are generally similar in transverse cross-section to an elongated header trim element 60 and a sill trim element 70 which has a slightly different transverse cross-sectional shape.

In accordance with the present invention, the side trim elements 50 are formed of extruded aluminum and are cut to appropriate length to trim the window 16 from stock lengths of extruded material. The jamb trim element includes a flange portion 52 adapted to project outwardly at right angles to the outer wall 42a of the window frame member when the trim element is attached thereto. Along the inner edge, the flange 52 is formed with a continuous elongated grooved out portion 53 having a base wall 52a along the inside edge of the flange 52 at right angles to the main body portion thereof, a wall 52b generally parallel to the main body and an L-shaped rib 52c having a tongue 54 adapted to seat in the groove 43 of the window frame member. A sharp edged rib 56 is provided on the wall section 52a to engage the outer surface of the window frame wall face 42a as shown in FIGS. 4 and 5, when the trim element 50 is pivotally interlocked and removed into place with the flange 52 substantially at right angles to the wall surface 42a of the window frame member.

Figure 4:
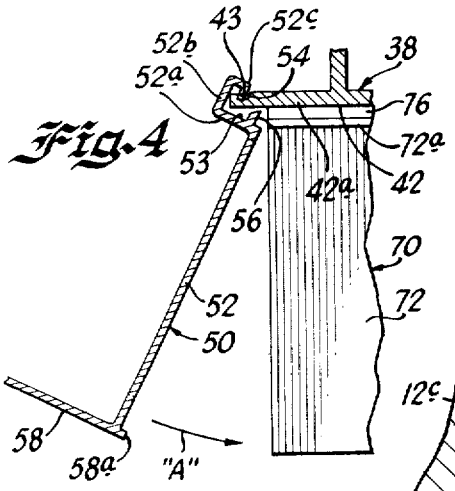
FIG. 4 is an enlarged, fragmentary, cross-sectional view similar to FIG. 2 but illustrating in somewhat animated form a pivotal interconnection between a replacement window frame edge and an elongated trim element in accordance with the features of the present invention.
Figure 5:
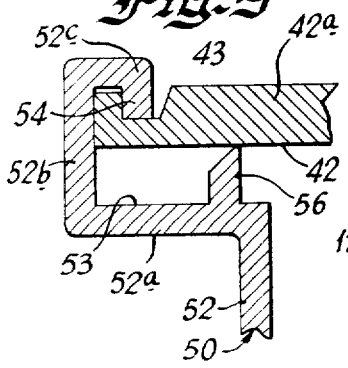
FIG. 5 is a greatly enlarged, fragmentary, horizontal cross-sectional view similar to FIG. 4 but illustrating in enlarged detail the pivotal interlock between the elongated trim element and the window frame member in accordance with the features of the present invention.

As best indicated in FIGS. 4 and 5, the side trim elements 50 are cut to length to run past the butt fitted ends of the upper, header trim element 60 and the lower, sill trim element 70 as illustrated. The side trim elements are attached to the stiles of the window frame by first engaging the tongue 54 within the elongated groove 43 and then pivoting the trim element in a counterclockwise direction as shown by the Arrow "A" in FIG. 4 until the main body of the flange 52 is substantially at right angles to the wall face 42a of the window frame member. In this position, the sharp edged tongue 54 stoppingly engages the outer surface of the window frame member 42a and limits further rotation in a counterclockwise direction. Rotation in the opposite clockwise direction, however, is permitted whenever it is desired to disassemble a side trim element 50 from a stile 38 of the window frame. The cooperating tongue 54 and groove 43 provide a continuous elongated, pivotal interconnection between the window frame and trim elements 50 and the rib 56 and wall 42a provide a limit stop as described so that assembly of the trim elements onto the sides of the window frame is easy and rapid.

Figure 2:
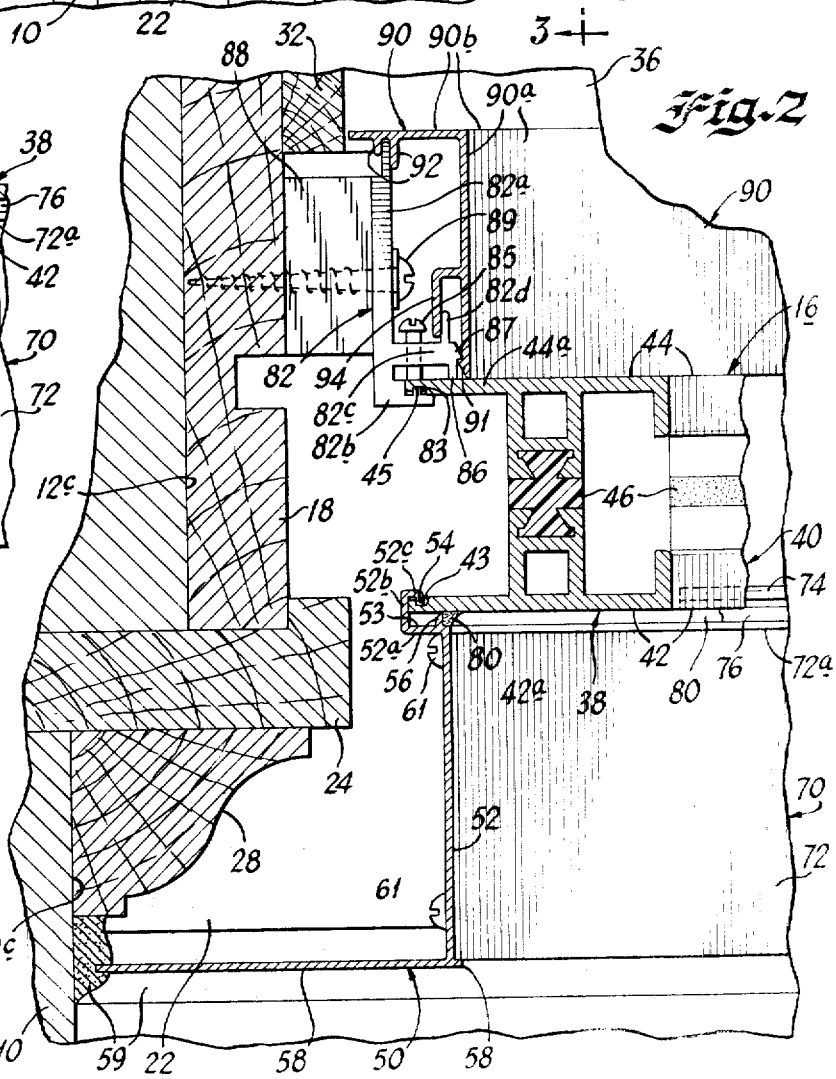
FIG. 2 is an enlarged, fragmentary, horizontal cross-sectional view taken substantially along lines 2—2 of FIG. 1.

The side trim elements 50 also include an outer fascia portion 58 at right angles to the flange portion 52 and generally in parallel with the outer surface wall 42a of the window frame. The fascia portions are adapted to bridge the space or opening between the side edge of the adjacent window frame member and the edge of an opening 12a, 12b, and 12c of the building wall and cover over the jamb elements 18, 24 and 28 of the old window frame which have been left in place after removal of the sash 14a and 14b. After a trimmed window 16 is mounted in a opening 12a, 12b, 12c, etc., a gunned-in bead of sealant or caulking material 59 is applied to provide sealing between an outer edge of the side trim element fascia 58 and the adjacent edge of the window opening in the building wall as shown in FIG. 2. This sealing is accomplished almost anytime after the window 16 with the trim element previously attached thereto has been mounted in place in the window opening of the building wall 10.

Figure 3:
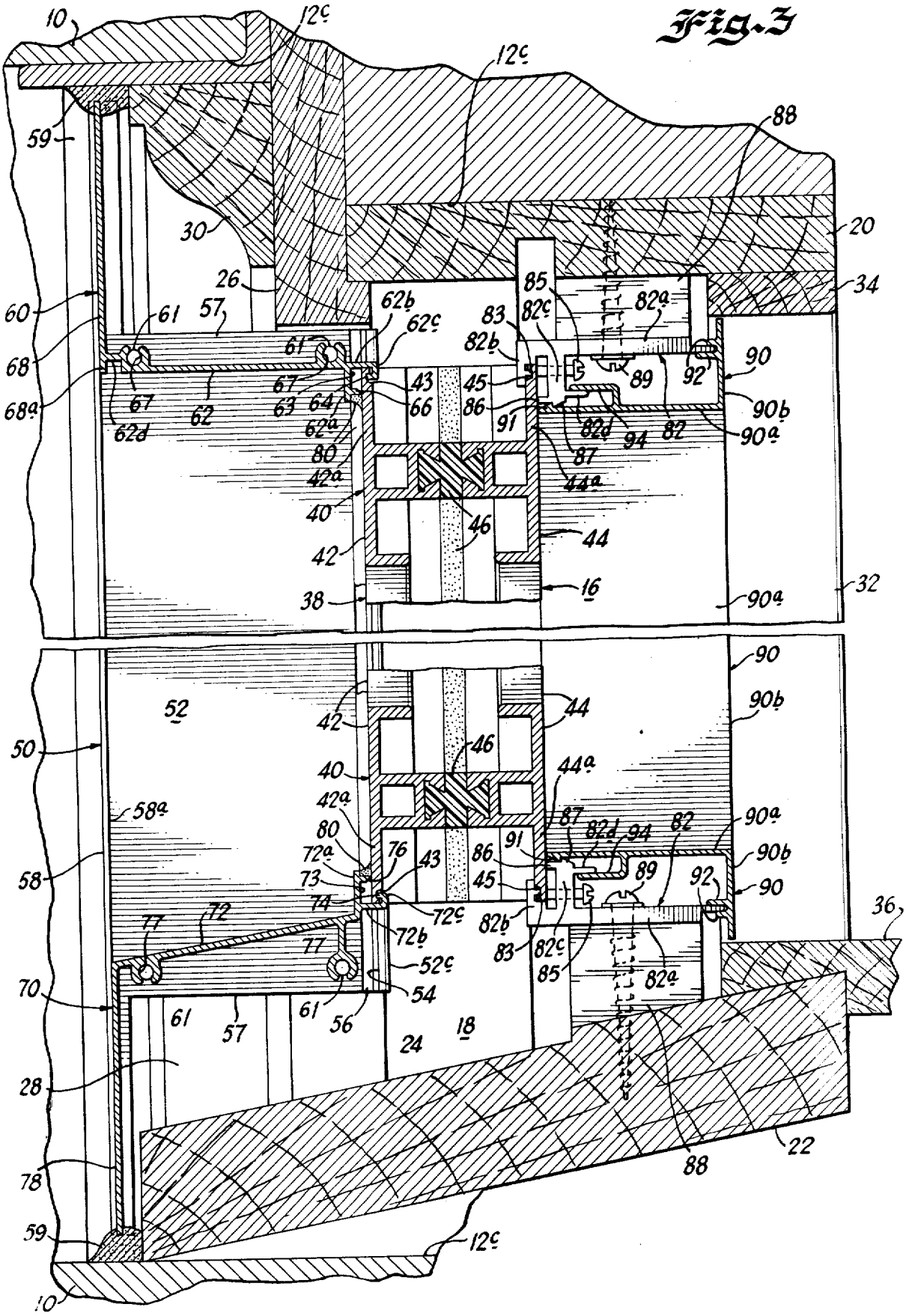
FIG. 3 is an enlarged, fragmentary, cross-sectional view taken substantially along lines 3—3 of FIG. 1.
Figure 7:
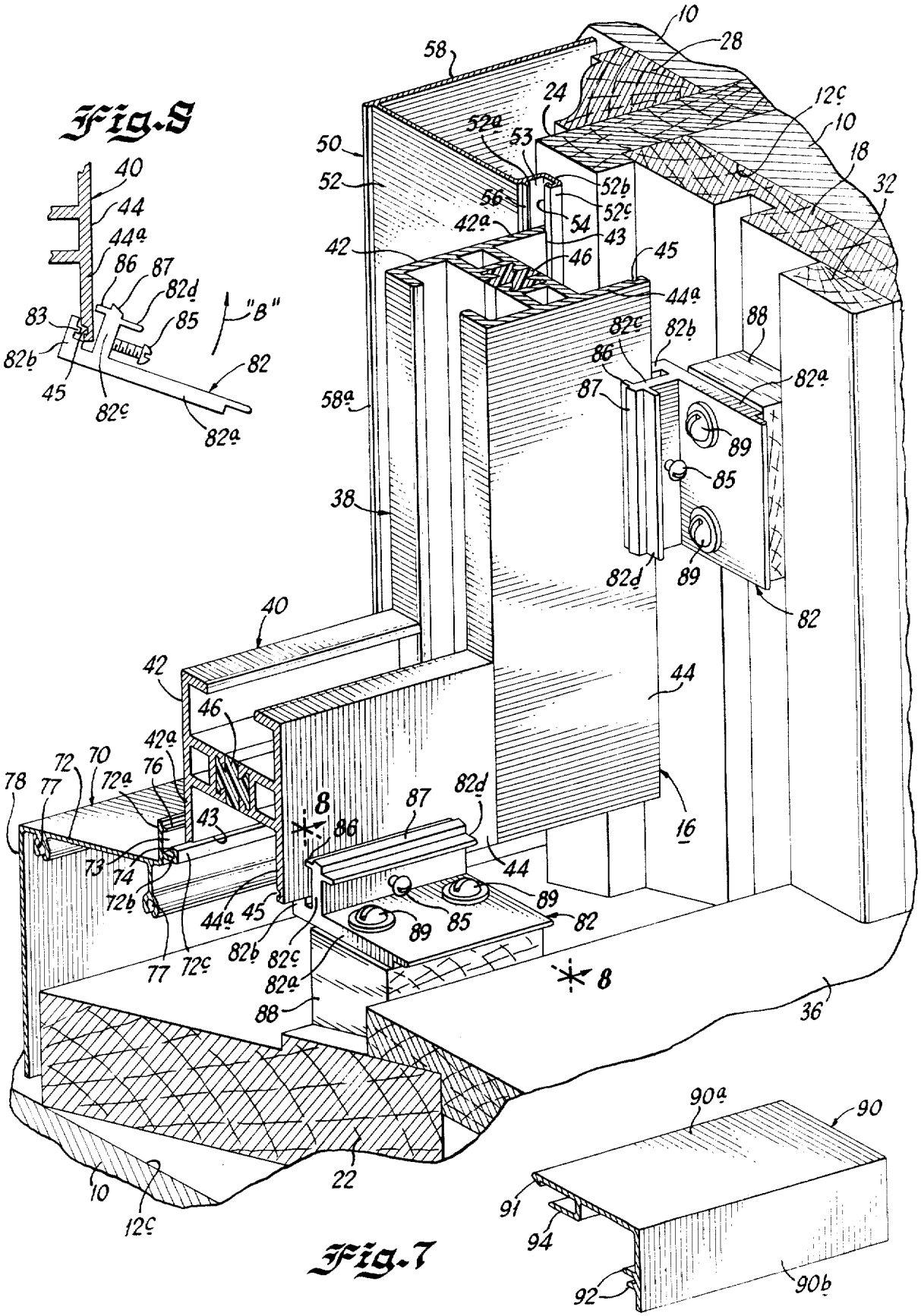
FIG. 7 is a fragmentary, enlarged, perspective view of a lower corner section of the window replacement system of the present invention as seen while looking outwardly from the inside of a building in which the replacement window and trim system has been installed.
Figure 5:
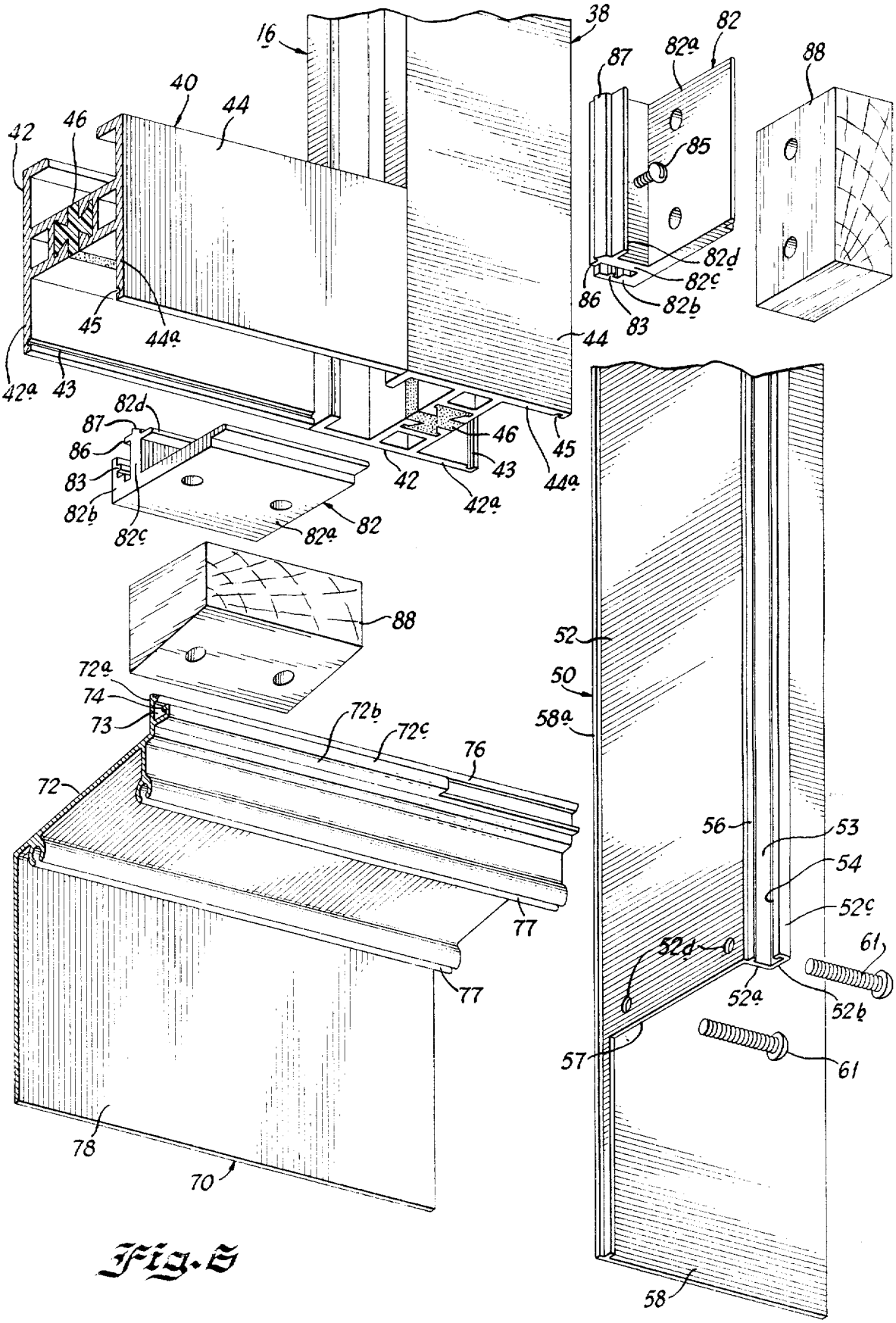

It should be noted that an inner edge of the fascia 58 projects inwardly toward the center of the window a slight distance beyond the perpendicular face of the flange 52 as shown in FIG. 2 in order to provide a small retaining rib 58a along the inside edge which aids in assembly of the header and sill trim elements 60 and 70 onto the frame of the window 16. It should also be noted that the flange 52 of the side trim elements 50 is coped away at the upper and lower corners at 55 and 57 in order to accommodate the upper brick molding 30 and the lower, existing sill 22 as shown in FIGS. 3 and 6. In addition, a pair of spaced apart holes 52d are drilled at appropriate upper and lower positions adjacent the coped corners to accommodate pairs of self-tapping fasteners 61 which are used for interconnecting the butt fitted ends of the horizontal trim elements 60 and 70 to the periphery of the window frame.

As indicated in FIG. 3, a pair of holes 52d are drilled in the flange 52 of the side trim elements 50 just below the coped out upper corner 55 in order to accommodate a pair of upper screw fasteners 61 while a similar pair of lower holes 52d as shown in FIG. 6, are drilled in the flange just above the upper level of the lower coped out portion 57 to accommodate the shanks of a pair of lower screw fasteners 61 used to attach the lower sill trim element 70 in butt fitted relation between the flanges 52 of the side trim elements 50.

In accordance with the present invention, the elongated, header trim element 60 is generally similar in transverse cross-section to the side trim elements 50 and includes a flange portion 62 adapted to extend outwardly of the outer face 42a of the upper header frame member of the replacement window 16 at right angles thereto. Along an inner edge, the flange portion 62 has a continuous groove 63 generally similar to the groove 53 and the groove is formed by a wall segment 62a parallel of the outer face member 42a, a segment 62b coextensive with the main body of the flange portion and an L-shaped or angular flange 62c having a tongue 64 adapted to inter-fit within the groove 43 on the wall face 42a of the upper header 40 of the frame of the window 16. A sharp edged tongue or stop 66 similar to the tongue 56 projects from the groove wall segment 62a to engage the outer face 42a of the window frame header and provide a pivot limiting stop engagement.

The flange 62a of the header trim element 60 is attached to the header rail 40 of the window frame in a manner similar to the pivotal, interlocking interconnection between the side trim elements 50 and the vertical stiles 38 of the window frame. As viewed in FIG. 3, after the tongue 64 is seated within the groove 43 in the window frame header 38, the header trim element 60 is then pivoted in a counterclockwise direction until the stop surface of a sharp edged tongue 66 engages the outer wall 42a of the window frame header to maintain the flange 62 normal to the wall and limit further rotation. In this position the flange 62 of the header trim element is substantially perpendicular or normal to the outer face of the window frame and transverse to the flanges 52 of the side trim elements 50. The header trim element 60 is cut to butt fitt between opposite facing flanges 52 of the side trim elements 50 and once in position therebetween, it is secured in place by the upper pair of threaded screw fasteners 61 which include threaded shanks driven through the upper pair of holes **52*d* to extend into a pair of integrally formed screw splines 67 formed on the inside surface of the flange 62**.

The header trim element 60 includes an upwardly extending outer fascia portion 68 integrally joined to an outer edge of the flange portion 62 and the flange is formed with a narrow upwardly offset portion **62*d* for providing a lower drip edge 68*a* along the lower edge of the fascia 68. It should also be noted that the outer face of the fascia 68 is dimensioned to seat against the inside edge of the ribs 58*a* on the side trim elements 50**.

The sill trim element 70 is substantially similar in transverse cross-section to the header trim element 60 but includes a downwardly and outwardly sloping flange portion 72 with a groove 73 formed by an upwardly extending wall segment **72*a*, an inwardly extending wall segment 72*b*, and an upstanding flange 72*c* completing the pocket which receives a lower edge of the outer face 42 of the lower rail 40 of the window frame. The pocket also includes an upper wall segment comprising a sharp edge tongue or stop 76 and an inside tongue 74 is adapted to pivotally interfit and interconnect the trim element 70 on the lower rail 40 in the groove 43 formed on the inside face of the wall member 42*a***.

A pair of integrally formed screw splines 77 are formed on the lower portion of the flange 72 for accommodating the threaded shanks of a pair of lower fasteners 61 projecting through the lower set of holes **52*d* which are provided in the flange 52 of the window side trim elements 50. The lower sill trim element 70 includes an outer fascia 78 parallel of the fascia 58 of the side trim elements 50 and the lower sill fascia is inset just behind the ribs 58*a*** on the side fascia as illustrated.

In accordance with the present invention, the rectangular frame of stiles 38 and rails 40 of the replacement window 16 is dimensioned to fit freely inside the existing wall opening **12*a*, 12*b*, 12*c*, etc. with the trim members of the original window left in place after the old window sashes 14*a* and 14*b*** have been removed.

In applying the trim elements to the frame of the window 16, the side trim elements 60 are first cut to length to fit within a window openings **12*a*, 12*b*, 12*c*, etc. and are then coped at the upper and lower ends as at 55 and 57. The flanges 52 are drilled with pairs of upper and lower holes 52*d* to accommodate the screw fasteners 61. The header trim element 60 and the sill trim element 70 are then cut to butt fit between the opposite side faces of the flanges 52 of the side trim element 50 and all of the trim elements are pivotally interconnected in position upon the respective window frame stile and rail members with the respective tongue and ribs 54, 64, 74, etc. engaged in the grooves 43. The respective trim elements are then rocked into final position as shown and the screw fasteners 61 are driven through the openings 52*d* into the pairs of screw splines 67 and 77 in the header trim element and sill trim element, respectively, and once these screws are driven home, the window frame of the replacement window 16 is provided with a complete and rigidly secured peripheral trim. A gunned-in-place seal of caulking material 80 is provided around the periphery of the window frame at the junction between the wall members 42*a* and the respective pockets 53, 63 and 73 of the trim elements 50, 60 and 70 attached thereto. When this seal is completed, the trimmed window 16 is ready for mounting and installation in an opening 12*a*, 12*b*, 12*c*, etc. of the existing wall structure 10**.

Mounting and installation of a trimmed window 16 is accomplished by means of a plurality of small clip elements 82 which are preferably formed of short lengths cut from a length of extruded aluminum or other metal having the transverse cross-section as shown. The clip elements are attached to the inner face members 44 of the window frame of the replacement window 16 at appropriate intervals along all sides. Each clip element includes a relatively large base portion **82*a* and a right angle flange 82*b* having a rib 83 thereon adapted to interlockingly and pivotally engage the grooves 45 on the inner surface of the inside face members 44*a* of the window frame, as best shown in FIG. 8. After interlocking engagement is made, the clip elements 82 are pivoted in a counterclockwise direction as shown by the Arrow "B" in FIG. 8, until the base 82*a* is substantially perpendicular or normal to the inside face portion or walls 44*a* of the window frame. To finally secure the clip elements in place, threaded screw fasteners 85 are tightened and these fasteners extend through threaded openings formed in an intermediate flange 82*c* provided on the clip elements. Each clip element is formed with a rib 86 adjacent the outer edge of the intermediate flange 82*c*, and the rib is designed as a stop to bear against the inside face 44*a* of the window frame when the screws 85 are finally tightened to hold the clip element securely in place. It will thus be seen that the clip elements may be easily and rapidly attached to the inside face members 44 of the replacement window frame at appropriate intervals on the frame members by first seating and interlocking the ribs 83 of the clip elements in the grooves 45 and finally tightening the fasteners 85. When this is accomplished, the base portions 82*a* of the clip elements project inwardly at right angles to the side faces 44*a*** of the window frame members in precision alignment.

After clip elements 82 have been attached to a trimmed window frame, the unit is bodily lifted into an awaiting opening **12*a*, 12*b*, 12*c*, etc. in the existing building wall 10. When in place, the base portion 82*a* of the clip elements are seated on shims or mounting block 88 of wood, which shims have been leveled and plumbed to vertical so that the frame of the window 16 will be properly aligned. Wood screws or other suitable fasteners 89 are then driven home through drilled holes in the clip element flanges 82*a* and suitable clearance holes in the mounting blocks or shims 88 until the threaded shanks are home in the existing window frame trim elements 20, 22 and 18** as illustrated.

This arrangement provides for a secure and rapid means for mounting a trimmed window frame in an existing opening. After the clips are secured in place to hold the window, the final outer caulking seal 59 is applied around the outer edges of the trim element fascia members 58, 68 and 78 to seal the replacement window into the existing building wall structure.

Once this step is completed, the building is closed in against the weather and interior trim stock may be applied to finish the installation procedure. Appropriate lengths of elongated interior trim elements 90 are cut and are snap fitted into the clip elements 82. The elongated trim elements preferably formed of extruded aluminum or other metal are cut to length to fit with the horizontals butt fitted against the flanged portions of the verticals. In general, the interior trim elements are of angular shaped, transverse cross-section and each includes a flange section 90a adapted to extend normal to the inside wall face 44a of the adjacent window frame member. On the free edge of the flange there is provided a wedge shaped rib 91 adapted to snappingly engage and interlock with a similar wedge shaped ridge 87 formed on the clip element flange 82c. The elongated interior trim elements 90 also include an interior fascia portion 90b perpendicular to the flange position 90a and the fascia portion is formed with a pair of spaced apart ribs on the interior surface thereof adapted to sandwich opposite sides of a thin edge portion of the face segment 82a of the clip elements as shown in FIGS. 2 and 3. The flange portion 90a of the interior trim elements is also provided with an integral L-shaped rib 94 having a free edge portion adapted to engage and slide against a rib 82d formed on the intermediate flange 82c of the clip elements. It will thus be seen that once an exteriorly trimmed replacement window 16 having previously had exterior trim elements 50, 60 and 70 attached thereto, is then mounted in a window opening 12a, 12b, 12c etc., and the clip elements 82 are fastened in place by the screws 89 and shims 88, the the elongated, interior trim elements 90 may then be cut to length and snapped in place onto the clip elements 82 by biasing the trim elements toward the clips until the wedge shaped ridges 87 and 91 snap into interlocking engagement.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. A method of replacing a window removed from an opening in an existing wall structure of a building comprising the steps of:

pre-attaching precut elongated trim elements along the periphery of a new window dimensioned to fit within said opening by interlocking each trim element along an outer edge of said window and rotating the same toward an outwardly extending position normal to an outer face of said window, and fastening said interlocked trim elements together at corners of said window to form a rectangular shaped trim around the periphery;

mounting said window in said opening after said trim elements are attached along the periphery thereof; and securing said window to building wall surfaces defining said opening.

2. The method of claim 1 including the step of:

sealing between said trim elements and an exterior surface of said building wall structure.

3. The method of claim 1 wherein one pair of said trim elements are formed with at least one longitudinally extending screw spline; and said fastening step comprises driving the threaded shank of a fastening screw through an opening in a face of a transversely extending trim element into a butt fitted end of said screw spline.

4. The method of claim 1 wherein said attaching step includes interlocking a longitudinally extending interlock means of said trim element with compatible means on an adjacent elongate frame member.

5. The method of claim 4 wherein said attaching step includes:

pivoting said interlocking trim element about an axis longitudinally parallel thereof.

6. The method of claim 5 wherein said pivoting step includes pivoting said trim element in one direction about said axis until engaged with stop means preventing further pivoting in said one direction.

7. The method of claim 6 including the further step of fastening said trim element against pivotal movement about said axis in a reverse direction while engaged with said stop means.

8. The method of claim 4 wherein said interlocking step comprises interfitting at least one mating, longitudinally extending rib and groove;

and pivoting said trim element in one direction about an axis parallel of the longitudinal direction of said trim element.

9. The method of claim 8 wherein said trim element is pivoted to interlock said rib in said groove and align a face portion of said trim element to extend angularly outwardly of an outer face of said longitudinal frame member.

10. The method of claim 8 or 9 wherein said trim element is pivoted until a stop surface of said trim element and said longitudinal frame member are in touching engagement.

11. The method of claim 8 wherein said pivoting step includes pivoting said trim element in one direction about said axis until engaged with stop means preventing further pivoting in said one direction

12. The method of claim 11 including the further step of fastening said trim element against pivotal movement about said axis in a reverse direction while engaged with said stop means.

13. The method of claim 1 including the step of sealing between said trim elements and said window.

14. The method of claim 13 wherein an elongated frame member of said window and said clip element include interlock means having a rib and groove; and said clip element is attached by inserting said rib in said groove and pivoting said clip element relative to said frame member to extend outwardly thereof.

15. The method of claim 14 wherein said elongated frame member is secured in said opening by applying a fastener between said clip element and said building wall surface defining said opening.

16. The method of claim 14 wherein said clip element is pivoted to interlock said rib in said groove and align a support face of said clip element to extend outwardly of said frame member for providing a window frame support surface for engagement with said building wall surface of said opening.

17. The method of claim 14 or 16 wherein said clip element is pivoted until a stop surface thereof and said frame member are in touching engagement.

18. The method of claim 17 including the step of applying a fastener between said clip element and said elongated frame member for holding said clip element in place thereon.

19. The method of claim 1 wherein said mounting step includes:

attaching at least one clip element on an inside portion of said window for supporting and securing said window in said opening.

20. The method of claim 19 wherein said clip attaching step comprises:

interlocking said clip element on an inside portion of said window for pivotal movement about an axis extending longitudinal of an elongated frame element of said window.

21. The method of claim 20 wherein said clip attaching step includes pivoting said inter-locked clip element in one direction about said axis until engaged with stop means preventing further pivoting in said one direction.

22. The method of claim 21 including the further step fastening said clip element against pivotal movement about said axis in a reverse direction while engaged with said stop means.

23. The method of claim 22 including the step of fastening said clip element to said existing wall structure in said opening.

24. The method of claim 1 or 19 including the step of attaching at least one interior trim element along an inside periphery of said window after said window is secured in said opening in said building wall structure.

25. The method of claim 24 including the step of attaching at least one interior trim element along the periphery of said window in interlocking relationship with said clip element.

26. The method of claim 25 wherein said interior trim element is snapped into interlocking engagement with said clip element by the application of force on said interior trim element directed toward said clip element.

27. The method of claim 25 wherein said interior trim element is snapped into interlocking engagement with said clip element by the application of force on said interior trim element directed toward said elongated frame member of said window.

28. Apparatus for trimming the periphery of a window for mounting in an opening of an existing wall structure of a building, comprising:

an elongated exterior trim element including a flange adapted to extend outwardly of a side frame member of said window and a fascia portion extending between said flange and an adjacent edge of said opening when said window is mounted therein, and elongated connector means along an inner edge of said flange for providing a continuous interlock between said frame member and said trim element, said elongated connector means including means forming a pivotal interconnection between an edge portion of said window frame member and said flange of said trim element continuously along the length thereof.

29. The apparatus of claim 28 wherein said elongated connector means includes one operative component of a rib and groove means having another operative component formed on said window frame member.

30. The apparatus of claim 29 wherein said elongated connector means includes a rib and said window frame includes a groove adjacent an edge portion for receiving said rib for interlocking said trim element with said window frame member.

31. The apparatus of claim 29 or 30 wherein said elongated connector means includes a groove for receiving a rib formed along an edge portion of said window frame member.

32. The apparatus of claim 28 wherein said trim element includes an elongated stop surface along said inner edge of said flange engagement against said window frame member to limit relative pivotal movement between said trim element and said window frame member in one direction.

33. The apparatus of claim 28 wherein a pair of said elongated exterior trim elements adapted to be attached along a pair of said frame members intersecting at a corner of a frame of said window, one of said trim elements having an end butt fitted against the flange of the other trim element and formed with at least one longitudinally extending screw spline adapted to receive a threaded shank of a fastener projecting through said flange of said other trim element for interconnecting said trim elements at right angles to each other.

34. The apparatus of claim 33 wherein said one trim element includes a pair of parallel spaced apart longitudinally extending screw splines positioned adjacent said inner edge of said flange and said fascia respectively, for receiving the threaded shanks of a pair of said fasteners projecting through said flange of said other trim element at right angles thereto.

35. The apparatus of claim 28 including at least one clip element for supporting said window in said opening of said building wall structure and attachable to said window frame member on an inside edge portion opposite said exterior trim element.

36. The apparatus of claim 35 wherein said clip element includes means forming a pivotal interconnection with an edge portion of said window frame member.

37. The apparatus of claim 36 wherein said pivotal interconnection means includes one operative component of a rib and groove means having another operative component formed on said window frame member.

38. The apparatus of claim 37 wherein said rib and groove means includes rib formed on said clip element and a longitudinally extending groove formed on said window frame member along an edge portion.

39. The apparatus of claim 38 including fastener means for securing said clip element with said rib engaged in said elongated groove at a selected position therealong.

40. The apparatus of claim 38 or 39 including stop means for limiting pivotal movement between said clip element and window frame member in one direction.

41. The apparatus of claim 40 wherein said stop means includes a stop surface engageable against said window frame member.

42. The apparatus of claim 41 including fastener means for holding said stop surface in engagement against said window frame member.

43. The apparatus of claim 35 including an elongated interior trim element adapted to be interlockingly engaged with said clip element and extending between said window frame member and an adjacent edge of said opening.

44. The apparatus of claim 43 including connector means for interconnecting said interior trim element and said clip element.

45. The apparatus of claim 46 wherein said connector means includes a first pair of interlocking connectors adjacent said window frame member and second interconnecting means spaced therefrom adjacent said adjacent edge of said opening.

46. The apparatus of claim 45 wherein said first pair of interlocking connectors includes a fixed engaging surface on one of said elements and a deflectable engaging surface on the other element movable into interlocking engagement therewith on movement of said interior trim element toward said window frame member.

47. The apparatus of claim 46 wherein at least one of said connectors includes a cam surface for deflecting the other connector to snappingly engage said engaging surfaces.

48. The apparatus of claim 44 wherein said second interconnecting means includes interfitting rib and groove means for aligning said trim element on said clip element adjacent said edge of said building opening.

49. The apparatus of claim 28 wherein said elongated connector means includes a pair of interfitting stop portions on said frame member and said trim element engageable to limit relative pivotal movement between frame member and said trim element in one direction.

50. The apparatus of claim 49 wherein said pair of interfitting stop portions include means permitting relative pivotal movement between said window frame member and said trim element in a direction opposite said one durection.

51. The apparatus of claim 49 wherein said stop portions are engageable in a stopping position to limit said relative pivotal movement with said fascia portion of said trim element generally parallel of an outer wall surface of said building.

52. The apparatus of claim 51 wherein said flange of said trim element is generally normal to said outer wall surface of said building with said stop portions in said stopping position.

* * * * *